US009857751B2

(12) United States Patent
Itoh

(10) Patent No.: US 9,857,751 B2
(45) Date of Patent: Jan. 2, 2018

(54) IMAGE FORMING APPARATUS, IMAGE FORMING METHOD, AND COMPUTER PROGRAM PRODUCT WHICH ADJUSTS A DENSITY VALUE OF A SPECIAL TONER

(71) Applicant: Takanori Itoh, Kanagawa (JP)

(72) Inventor: Takanori Itoh, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/113,944

(22) PCT Filed: Jan. 29, 2015

(86) PCT No.: PCT/JP2015/053163

§ 371 (c)(1),
(2) Date: Jul. 25, 2016

(87) PCT Pub. No.: WO2015/115672

PCT Pub. Date: Aug. 6, 2015

(65) Prior Publication Data

US 2016/0342121 A1 Nov. 24, 2016

(30) Foreign Application Priority Data

Jan. 31, 2014 (JP) ..... 2014-017437
Dec. 12, 2014 (JP) ..... 2014-252326

(51) Int. Cl.
*G03G 15/00* (2006.01)
*G03G 15/01* (2006.01)

(52) U.S. Cl.
CPC ..... *G03G 15/6585* (2013.01); *G03G 15/01* (2013.01); *G03G 15/5029* (2013.01);
(Continued)

(58) Field of Classification Search
CPC ..... G03G 15/01; G03G 15/6585; G03G 15/6591; G03G 15/1625; G03G 15/5029;
(Continued)

(56) References Cited

U.S. PATENT DOCUMENTS

2008/0124099 A1* 5/2008 Koinuma ..... G03G 15/6582 399/40
2008/0236736 A1* 10/2008 Nakamura ..... B65H 7/14 156/277

(Continued)

FOREIGN PATENT DOCUMENTS

EP 2 221 673 A1 8/2010
EP 2 306 250 A1 4/2011

(Continued)

OTHER PUBLICATIONS

International Search Report dated Apr. 21, 2015 in PCT/JP2015/053163 filed Jan. 29, 2015.

(Continued)

*Primary Examiner* — Robert Beatty
(74) *Attorney, Agent, or Firm* — Oblon, McClelland, Maier & Neustadt, L.L.P.

(57) ABSTRACT

An image forming apparatus includes: an image forming unit that forms, on a recording medium, an image including a special image based on special image data specifying a density value of a special toner that gives a special effect and a color image based on color image data specifying a density value of a color toner; a determining unit that determines whether the image is to be observed from an image formation surface or the image is to be observed from a surface opposite to the image formation surface through the recording medium; and an adjusting unit that performs adjustment to reduce the density value of the special image data based on a result of determination made by the determining unit.

9 Claims, 10 Drawing Sheets

| TYPE OF SPECIAL TONER | OBSERVATION SURFACE | ADJUSTMENT CONTENT |
|---|---|---|
| TRANSPARENT TONER | SURFACE OPPOSITE TO IMAGE FORMATION SURFACE | REDUCTION IN DENSITY |
| TRANSPARENT TONER | IMAGE FORMATION SURFACE | NO ADJUSTMENT IN DENSITY |
| WHITE TONER | SURFACE OPPOSITE TO IMAGE FORMATION SURFACE | NO ADJUSTMENT IN DENSITY |
| WHITE TONER | IMAGE FORMATION SURFACE | REDUCTION IN DENSITY |

(52) U.S. Cl.
CPC ..... *G03G 2215/00497* (2013.01); *G03G 2215/0129* (2013.01)

(58) Field of Classification Search
CPC ..... G03G 2215/00493; G03G 2215/00497; G03G 2215/00502; G03G 2215/00751; G03G 2215/00801; G03G 2215/00805
USPC ..... 399/40, 45
See application file for complete search history.

(56) References Cited

U.S. PATENT DOCUMENTS

| | | | | |
|---|---|---|---|---|
| 2009/0034998 | A1 | 2/2009 | Omata | |
| 2010/0195126 | A1 | 8/2010 | Shiozawa | |
| 2011/0076073 | A1 | 3/2011 | Omata | |
| 2012/0062956 | A1 | 3/2012 | Kitagawa et al. | |
| 2012/0063802 | A1 | 3/2012 | Suzuki et al. | |
| 2013/0279958 | A1 | 10/2013 | Yukie et al. | |
| 2014/0147148 | A1* | 5/2014 | Kiuchi | G03G 15/2046 399/67 |
| 2015/0029518 | A1* | 1/2015 | Tashiro | G03G 15/5025 358/1.1 |
| 2015/0029520 | A1 | 1/2015 | Itoh | |
| 2015/0093553 | A1* | 4/2015 | Tyagi | B42D 15/0093 428/207 |
| 2015/0093701 | A1* | 4/2015 | Tyagi | G03G 13/20 430/117.5 |
| 2015/0220041 | A1 | 8/2015 | Yukie et al. | |
| 2015/0346622 | A1* | 12/2015 | Itoh | G03G 15/01 399/39 |
| 2016/0216676 | A1 | 7/2016 | Yukie et al. | |

FOREIGN PATENT DOCUMENTS

| | | | | |
|---|---|---|---|---|
| JP | 10-177285 | A | | 6/1998 |
| JP | 10177285 | A | * | 6/1998 |
| JP | 2004-330675 | | | 11/2004 |
| JP | 2006-220694 | A | | 8/2006 |
| JP | 2007083634 | A | * | 4/2007 |
| JP | 2008-276056 | | | 11/2008 |
| JP | 2009-058941 | | | 3/2009 |
| JP | 2012-083736 | | | 4/2012 |
| JP | 2012-084135 | | | 4/2012 |
| JP | 2013-024888 | | | 2/2013 |

OTHER PUBLICATIONS

Extended European Search Report dated Dec. 21, 2016 in Patent application No. 15742942.4.

* cited by examiner

FIG.4A

| INSTRUCTION INFORMATION | OBSERVATION SURFACE |
|---|---|
| FRONT SIDE | IMAGE FORMATION SURFACE |
| BACK SIDE | SURFACE OPPOSITE TO IMAGE FORMATION SURFACE |

FIG.4B

| INSTRUCTION CONTENT | TYPE OF RECORDING MEDIUM | |
|---|---|---|
| | TRANSPARENT | NON-TRANSPARENT |
| PRESENCE OF MIRROR-IMAGE PRINTING SPECIFICATION | SURFACE OPPOSITE TO IMAGE FORMATION SURFACE | IMAGE FORMATION SURFACE |
| ABSENCE OF MIRROR-IMAGE PRINTING SPECIFICATION | IMAGE FORMATION SURFACE | IMAGE FORMATION SURFACE |

FIG.4C

| TYPE OF RECORDING MEDIUM | OBSERVATION SURFACE |
|---|---|
| TRANSPARENT | SURFACE OPPOSITE TO IMAGE FORMATION SURFACE |
| NON-TRANSPARENT | IMAGE FORMATION SURFACE |

FIG.5

| TYPE OF SPECIAL TONER | OBSERVATION SURFACE | ADJUSTMENT CONTENT |
|---|---|---|
| TRANSPARENT TONER | SURFACE OPPOSITE TO IMAGE FORMATION SURFACE | REDUCTION IN DENSITY |
| TRANSPARENT TONER | IMAGE FORMATION SURFACE | NO ADJUSTMENT IN DENSITY |
| WHITE TONER | SURFACE OPPOSITE TO IMAGE FORMATION SURFACE | NO ADJUSTMENT IN DENSITY |
| WHITE TONER | IMAGE FORMATION SURFACE | REDUCTION IN DENSITY |

IMAGE FORMING APPARATUS, IMAGE FORMING METHOD, AND COMPUTER PROGRAM PRODUCT WHICH ADJUSTS A DENSITY VALUE OF A SPECIAL TONER

TECHNICAL FIELD

The present invention relates to an image forming apparatus, an image forming method, and a computer program product.

BACKGROUND ART

To record a color image, toners or inks of four colors of cyan (C), magenta (M), yellow (Y), and black (K) are typically used, for example. Recently, there have been developed and known methods for applying a protective material to give a special effect or the like to a recording medium (refer to Patent Literature 1, for example). Examples of the protective material include a transparent or white special toner that can give a special effect.

Patent Literature 1 describes a configuration that sets the amount of a toner per unit area of a transparent image based on the specification of an image formation mode from a high-gloss image formation mode and a low-gloss image formation mode.

The recording medium to which the special toner is applied has various uses. The conventional technologies may possibly apply the special toner more than necessary to provide a desired special effect and thus apply the special toner more than the amount with which the desired special effect can be provided.

In view of the above, there is a need to provide an image forming apparatus, an image forming method, and a computer program product that can reduce the amount of consumption of a special toner.

SUMMARY OF THE INVENTION

An image forming apparatus includes: an image forming unit that forms, on a recording medium, an image including a special image based on special image data specifying a density value of a special toner that gives a special effect and a color image based on color image data specifying a density value of a color toner; a determining unit that determines whether the image is to be observed from an image formation surface or the image is to be observed from a surface opposite to the image formation surface through the recording medium; and an adjusting unit that performs adjustment to reduce the density value of the special image data based on a result of determination made by the determining unit.

An image forming method is performed by an image forming apparatus including an image forming unit that forms, on a recording medium, an image including a special image based on special image data specifying a density value of a special toner that gives a special effect and a color image based on color image data specifying a density value of a color toner. The image forming method includes: determining whether the image is to be observed from an image formation surface or the image is to be observed from a surface opposite to the image formation surface through the recording medium; and performing adjustment to reduce the density value of the special image data based on a result of determination made at the determining.

A computer program product includes a non-transitory computer-readable medium containing an information processing program. The program causes a computer connected to an image forming unit that forms, on a recording medium, an image including a special image based on special image data specifying a density value of a special toner that gives a special effect and a color image based on color image data specifying a density value of a color toner to perform: determining whether the image is to be observed from an image formation surface or the image is to be observed from a surface opposite to the image formation surface through the recording medium; and performing adjustment to reduce the density value of the special image data based on a result of determination made at the determining.

BRIEF DESCRIPTION OF DRAWINGS

FIGS. 4A to 4C are diagrams of examples of data structures of front and back determination conditions.

FIG. 5 is a diagram of an example of a data structure of adjustment conditions.

DESCRIPTION OF EMBODIMENTS

Exemplary embodiments of an image forming apparatus, an image forming method, and a computer program product are described below in greater detail with reference to the accompanying drawings.

Figure 1:
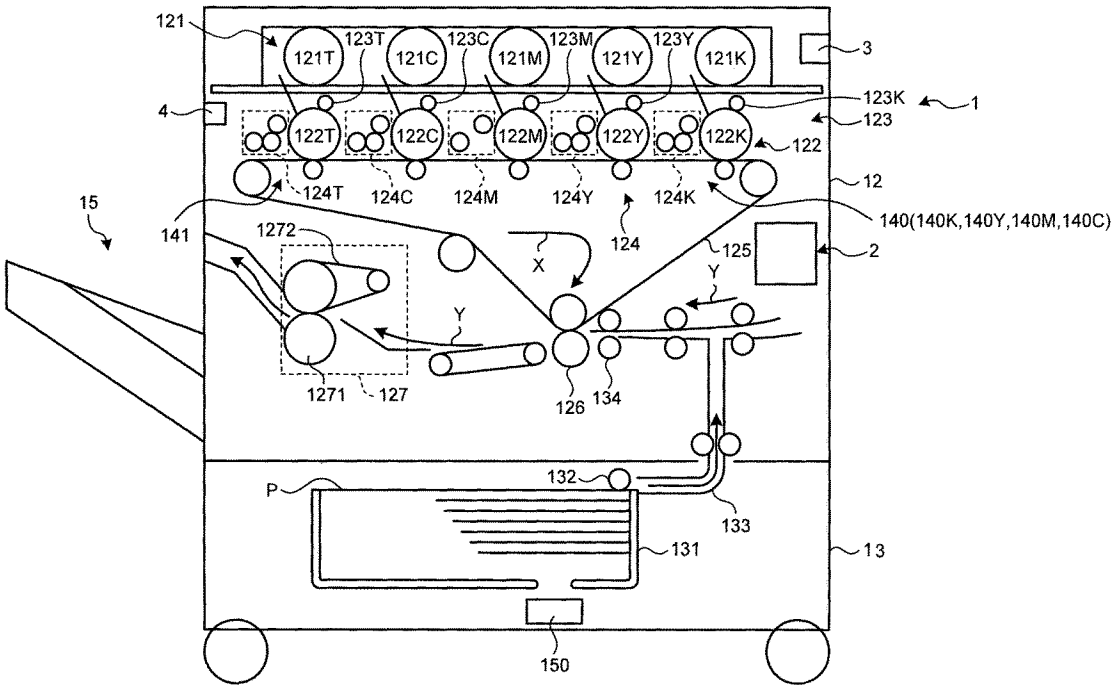
FIG. 1 is a schematic of a configuration of an image forming apparatus.

FIG. 1 is a schematic of a configuration of an image forming apparatus 10 according to the present embodiment. The image forming apparatus 10 includes an image forming unit 1, a control unit 2, an operating unit 3, and a communication unit 4.

The operating unit 3 receives input of various types of operating instructions from a user. The operating unit 3 is a keyboard or a touch panel, for example. The communication unit 4 is a communication interface that communicates with an external device.

The image forming unit 1 forms an image with toners on a recording medium P. The image forming unit 1 according to the present embodiment forms a special image and a color image on the recording medium P.

The special image is formed based on special image data specifying the density value of a special toner that gives a special effect. The color image is formed based on color image data specifying the density value of a color toner.

The special toner can give a special effect. The special toner covers the recording medium P and/or a portion of the color image formed on the recording medium P, thereby giving a special effect, such as gloss, to the recording medium P and/or the color image.

The special toner according to the present embodiment is a colorless and transparent toner or a white toner. Being transparent means having transmittance of light equal to or higher than 70%. The white toner is made of resin containing titanium oxide as a pigment, for example. Because the white toner has a light-blocking property, the white toner is used to eliminate an influence of the back side of a transparent recording medium P to which the color toner is applied, for example. The light-blocking property of the white toner is incomplete. By reducing the amount of the white toner applied to the recording medium P, the white toner can allow part of light to pass therethrough, thereby creating a translucent state. Being translucent means having transmittance of light equal to or higher than 30% and lower than 70%. The special toner may be any type of toner as long as it can give a special effect as described above and is not limited to the white toner and the transparent toner. The special toner may be a glossy (e.g., gold or silver) toner, for example.

The color toner is a colored toner, such as C, M, Y, and K.

The image forming unit 1 includes a printer unit 12.

The printer unit 12 has a known structure that forms an image with an electrophotography system. The printer unit 12 includes a printer unit 141 and a printer unit 140. The printer unit 141 forms a special image with the special toner, whereas the printer unit 140 forms a color image with the color toner. In the present embodiment, the printer unit 141 that forms a special image is provided upstream of the printer unit 140 that forms a color image in the conveying direction (the arrow X direction in FIG. 1) of an intermediate transfer belt 125.

The printer unit 140 includes printer units 140K, 140Y, 140M, and 140C. The printer units 140K, 140Y, 140M, and 140C form color images with the color toners of K, Y, M, and C, respectively.

The printer unit 141 that forms a special image includes a cartridge 121T, a photoconductor drum 122T, a charging unit 123T, a developing unit 124T, and a transfer unit (not illustrated).

The cartridge 121T holds the special toner. The cartridge 121T supplies the special toner to the developing unit 124T. The charging unit 123T uniformly charges the surface of the photoconductor drum 122T. The photoconductor drum 122T is rotated in a direction opposite to that of the intermediate transfer belt 125. A scanning unit, which is not illustrated, forms an electrostatic latent image based on the special image data on the uniformly charged surface of the photoconductor drum 122T. When the area in which the electrostatic latent image is formed on the photoconductor drum 122T reaches an area facing the developing unit 124T along with the rotation of the photoconductor drum 122T, the area is developed with the special toner. When the special image formed by developing the electrostatic latent image with the special toner reaches an area facing the intermediate transfer belt 125, the special image is transferred onto the intermediate transfer belt 125.

The printer unit 140C forms a cyan image as the color image and includes a cartridge 121C, a photoconductor drum 122C, a charging unit 123C, a developing unit 124C, and a transfer unit (not illustrated). The printer unit 140M forms a magenta image as the color image and includes a cartridge 121M, a photoconductor drum 122M, a charging unit 123M, a developing unit 124M, and a transfer unit (not illustrated). The printer unit 140Y forms a yellow image as the color image and includes a cartridge 121Y, a photoconductor drum 122Y, a charging unit 123Y, a developing unit 124Y, and a transfer unit (not illustrated). The printer unit 140K forms a black image as the color image and includes a cartridge 121K, a photoconductor drum 122K, a charging unit 123K, a developing unit 124K, and a transfer unit (not illustrated).

The printer units 140C, 140M, 140Y, and 140K are the same as the printer unit 141 except that they use the color toner (color toners of C, M, Y, and K, respectively) as the toner instead of the special toner and use the color image data (color image data for the respective colors) instead of the special image data.

In the present embodiment, the printer unit 141 that forms a special image is provided upstream of the printer unit 140 that forms a color image in the conveying direction (the arrow X direction in FIG. 1) of the intermediate transfer belt 125 as described above. With this configuration, the printer unit 141 transfers the special image onto the intermediate transfer belt 125, and the printer unit 140 then transfers the color image onto the intermediate transfer belt 125.

The image obtained by transferring on the intermediate transfer belt 125 in the order of the special image and the color image is transferred onto the recording medium P conveyed from a sheet feeding unit 13. Thus, the image is formed on the recording medium P with the color image and the special image formed in this order. The image formed on the recording medium P is conveyed to a fixing unit 127.

The fixing unit 127 includes a pressure roller 1271, and a fixing belt 1272, for example, and fixes the image onto the recording medium P conveyed from secondary transfer rollers 126. The recording medium P on which the image is fixed is discharged to a discharge tray 15.

The sheet feeding unit 13 includes a sheet feed tray 131, a sheet feeding roller 132, a sheet feeding belt 133, and registration rollers 134. The sheet feed tray 131 houses the recording medium P.

The sheet feeding roller 132 pulls out the recording medium P housed in the sheet feed tray 131 and supplies it to the sheet feeding belt 133. The sheet feeding belt 133 conveys the recording medium P into the registration rollers 134. The registration rollers 134 convey the recording medium P into a nipped portion between the intermediate transfer belt 125 and the secondary transfer roller 126.

The image forming apparatus 10 according to the present embodiment includes a detecting unit 150. The detecting unit 150 detects whether the recording medium P is transparent or non-transparent.

The detecting unit 150 is arranged at a position where it can detect the recording medium P housed in the sheet feeding unit 13. The detecting unit 150 according to the present embodiment is arranged at a position where it can detect the recording medium P through a hole (not illustrated) formed on the bottom of the sheet feed tray 131.

Figure 2:
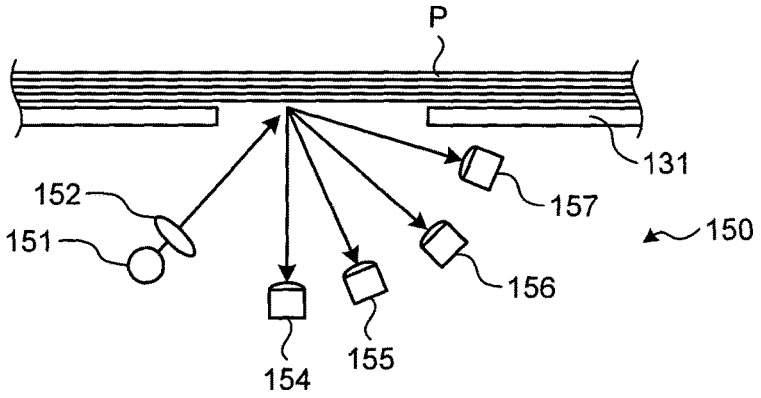
FIG. 2 is a schematic for explaining an example of a detecting unit.

The detecting unit 150 may be a known sensor. FIG. 2 is a schematic for explaining an example of the detecting unit 150.

The detecting unit 150 includes a light source 151, a condenser lens 152, and a plurality of light receiving sensors 154 to 157. The condenser lens 152 condenses light output from the light source 151 toward the recording medium P to be measured. The light receiving sensors 154 to 157 receives light reflected by the recording medium P. The light receiving sensors 154 to 157 are arranged at different positions so as to receive the light reflected by the recording medium P in various directions. The detecting unit 150 detects whether the recording medium P is transparent or non-transparent based on the ratio of output signals detected by the light receiving sensors 154 to 157, for example.

The image forming apparatus 10 may be a multifunction peripheral having any other known function, such as a scanner function and a facsimile function, besides the printer function to form an image on the recording medium P.

Figure 3:
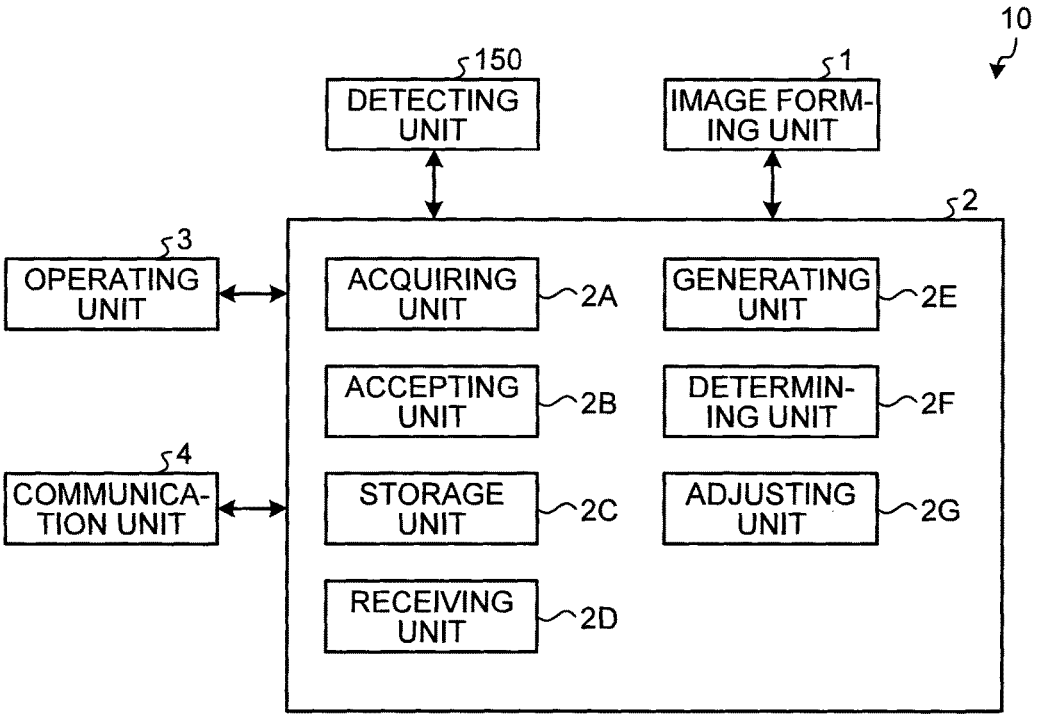
FIG. 3 is a block diagram of a functional configuration of the image forming apparatus.

FIG. 3 is a block diagram of a functional configuration of the image forming apparatus 10.

The image forming apparatus 10 includes the detecting unit 150, the image forming unit 1, the operating unit 3, the communication unit 4, and the control unit 2. The detecting unit 150, the image forming unit 1, the operating unit 3, and the communication unit 4 are electrically connected to the control unit 2.

The control unit 2 controls each unit provided to the image forming apparatus 10. The control unit 2 is a computer including a central processing unit (CPU), for example. The control unit 2 may be a circuit other than a CPU, for example.

The control unit 2 includes an acquiring unit 2A, an accepting unit 2B, a storage unit 2C, a receiving unit 2D, a generating unit 2E, a determining unit 2F, and an adjusting unit 2G. All or a part of the acquiring unit 2A, the accepting unit 2B, the receiving unit 2D, the generating unit 2E, the determining unit 2F, and the adjusting unit 2G may be provided by a processing device, such as a CPU, executing a computer program, that is, by software. Alternatively, all or a part of these units may be provided by hardware, such as an integrated circuit (IC), or a combination of software and hardware.

The acquiring unit 2A acquires a detection result from the detecting unit 150. The detection result indicates whether the recording medium P on which an image is to be formed is transparent or non-transparent.

The accepting unit 2B accepts the contents of an operating instruction issued by the user through the operating unit 3. The accepting unit 2B according to the present embodiment accepts input of specification information as the contents of an operating instruction. The specification information specifies an observation surface of the image on the recording medium P. The operating unit 3, for example, displays a predetermined area or an operation button used to input whether to observe the front side or the back side of the recording medium P as the observation surface. By selecting the operation button displayed on the operating unit 3 and issuing an instruction, the user inputs the specification information for specifying the observation surface of the image on the recording medium P.

In a case where the observation surface is the front side, the user views the image formed on the recording medium P from an image formation surface of the recording medium P. By contrast, in a case where the observation surface is the back side, the user views the image formed on the recording medium P from the surface opposite to the image formation surface of the recording medium P through the recording medium P.

The accepting unit 2B may accept specification of mirror-image printing for performing mirror-image conversion on the image and printing the image (hereinafter referred to as mirror-image printing specification) from the operating unit 3 as the contents of an operating instruction.

The receiving unit 2D receives print data from an external device via the communication unit 4. The print data includes color print data and special print data. The color print data specifies the density value of a color image. The color print data is bitmap or vector data represented by color specification, such as RGB, CMYK, and CIELAB, or in a format of monochrome gradation.

The special print data specifies the density value depending on the type of a special effect to be given to the recording medium P for each area to which the special effect is to be given. The special print data is bitmap or vector data represented in a format of monochrome gradation. Specifically, a larger density value is associated with the type of a special effect represented with a larger amount of the special toner and a smaller density value is associated with the type of a special effect represented with a smaller amount of the special toner.

The user or the like who operates the external device sets the area to which the special effect is to be given and the type of the special effect, thereby creating the special print data. In other words, by forming a special image based on the special print data, it is possible to give a specific special effect to a part or the entire surface of the recording medium P. While the special effect is a plurality of types of glossiness having different degrees of glossiness, for example, it is not limited thereto.

The generating unit 2E converts the print data into data in a format processable by the image forming unit 1, thereby generating image data. The image data includes the color image data and the special image data.

The generating unit 2E according to the present embodiment converts the color print data included in the print data into bitmap data specifying the density value of the color toner for each pixel and into the CMYK color system. Thus, the generating unit 2E generates color image data of CMYK.

Similarly, the generating unit 2E converts the special print data included in the print data into bitmap data specifying the density value of the special toner for each pixel. Thus, the generating unit 2E generates special image data.

In the present embodiment, the color image data and the special image data represent the density value of each pixel by a dot area ratio of 0% to 100%. A pixel having a density value closer to 0% requires a smaller amount of the toner and a pixel having a density value closer to 100% requires a larger amount of the toner. The color image data and the special image data may represent the density value of each pixel by 8 bits, that is, represent the density value with a value of 0 to 255. In this case, a pixel having a density value closer to 0 requires a smaller amount of the toner and a pixel having a density value closer to 255 requires a larger amount of the toner.

The storage unit 2C stores therein various types of information. The storage unit 2C may be a read only memory (ROM), a random access memory (RAM), or a hard disk drive (HDD). The storage unit 2C according to the present embodiment stores therein front and back determination conditions and adjustment conditions in advance.

The front and back determination conditions are information indicating determination conditions for determining whether the image formed on the recording medium P based on the image data is to be observed from the image formation surface or observed from the surface opposite to the image formation surface through the recording medium P. "The image formation surface" indicates that the image formed on the recording medium P based on the image data is to be observed from the image formation surface. "The surface opposite to the image formation surface" indicates that the image formed on the recording medium P based on the image data is to be observed from the surface opposite to the image formation surface through the recording medium P.

FIG. 4A is a diagram of an example of a data structure of the front and back determination conditions. As illustrated in FIG. 4A, the front and back determination conditions are data in which the specification information is associated with the observation surface. The specification information is information (information indicating the observation surface of the image) accepted by the accepting unit 2B through the operating unit 3. In the present embodiment, the specification information indicates the front side or the back side. As illustrated in FIG. 4A, the storage unit 2C registers in advance the observation surface "image formation surface" corresponding to the specification information "front side" as the front and back determination conditions. The storage unit 2C also registers in advance the observation surface "surface opposite to the image formation surface" corresponding to the specification information "back side" as the front and back determination conditions.

The front and back determination conditions stored in the storage unit 2C are not limited to those illustrated in FIG. 4A. The front and back determination conditions may be those illustrated in FIG. 4B or FIG. 4C, for example.

FIG. 4B is a diagram of another example of the data structure of the front and back determination conditions. As illustrated in FIG. 4B, the front and back determination conditions may be data in which the specification content, the type of the recording medium P, and the observation surface are associated with one another. The specification content indicates the content accepted by the accepting unit 2B through the operating unit 3 from the user. The specification content is presence of mirror-image printing specification indicating that specification of mirror-image printing is accepted, or absence of mirror-image printing specification indicating that no specification of mirror-image printing is accepted. The type of the recording medium P is the type of the recording medium P detected by the detecting unit 150. The type of the recording medium P is transparent or non-transparent.

In the example illustrated in FIG. 4B, the storage unit 2C registers in advance the observation surface "surface opposite to the image formation surface" corresponding to the instruction content "presence of mirror-image printing specification" and the type of the recording medium P "transparent" as the front and back determination conditions. The storage unit 2C also registers in advance the observation surface "image formation surface" corresponding to the instruction content "presence of mirror-image printing specification" and the type of the recording medium P "non-transparent" as the front and back determination conditions. The storage unit 2C also registers in advance the observation surface "image formation surface" corresponding to the instruction content "absence of mirror-image printing specification" and the type of the recording medium P "transparent" as the front and back determination conditions. The storage unit 2C also registers in advance the observation surface "image formation surface" corresponding to the instruction content "absence of mirror-image printing specification" and the type of the recording medium P "non-transparent" as the front and back determination conditions.

FIG. 4C is a diagram of still another example of the data structure of the front and back determination conditions. As illustrated in FIG. 4C, the front and back determination conditions may be data in which the type of the recording medium is associated with the observation surface. The type of the recording medium P indicates the type of the recording medium P detected by the detecting unit 150. Specifically, the type of the recording medium P is transparent or non-transparent. The observation surface is the surface opposite to the image formation surface or the image formation surface.

In the example illustrated in FIG. 4C, the storage unit 2C registers in advance the observation surface "surface opposite to the image formation surface" corresponding to the type of the recording medium P "transparent" as the front and back determination conditions. The storage unit 2C also registers in advance the observation surface "image formation surface" corresponding to the type of the recording medium P "non-transparent" as the front and back determination conditions.

The following describes adjustment conditions stored in advance in the storage unit 2C. The adjustment conditions are information indicating the contents of adjustment in the density of the special image data depending on the observation surface of the image. FIG. 5 is a diagram of an example of a data structure of the adjustment conditions.

As illustrated in FIG. 5, the adjustment conditions are data in which the type of the special toner, the observation surface, and the adjustment content are associated with one another. The type of the special toner is the transparent toner or the white toner. The observation surface is the surface opposite to the image formation surface or the image formation surface as described above. The adjustment content is information indicating whether to adjust the density value of the special image data. In the present embodiment, the adjustment content is information indicating "reduction in density" instructing to reduce the density value corresponding to all the pixels specified for the special image data or information indicating "no adjustment in density" instructing to perform no adjustment in the density.

In the example illustrated in FIG. 5, the storage unit 2C registers in advance the adjustment content "reduction in density" corresponding to the type of the special toner "transparent toner" and the observation surface "surface opposite to the image formation surface" as the adjustment conditions. The storage unit 2C also registers in advance the adjustment content "no adjustment in density" corresponding to the type of the special toner "transparent toner" and the observation surface "image formation surface" as the adjustment conditions.

By contrast, the storage unit 2C registers in advance the adjustment content "no adjustment in density" corresponding to the type of the special toner "white toner" and the observation surface "surface opposite to the image formation surface" as the adjustment conditions. The storage unit 2C also registers in advance the adjustment content "reduction in density" corresponding to the type of the special toner "white toner" and the observation surface "image formation surface" as the adjustment conditions. Thus, the storage unit 2C stores therein in advance the adjustment conditions specifying adjustment contents opposite to each other in the case of using the white toner as the special toner and the case of using the transparent toner.

In a case where the special toner is a non-transparent toner (having transmittance of light lower than 70%) other than the white toner, the storage unit 2C simply needs to store therein in advance adjustment conditions similar to those of the "white toner". The storage unit 2C, for example, registers in advance the adjustment content "no adjustment in density" corresponding to the type of the special toner "non-transparent toner" and the observation surface "surface opposite to the image formation surface" as the adjustment conditions. The storage unit 2C also registers in advance the adjustment content "reduction in density" corresponding to the type of the special toner "non-transparent toner" and the observation surface "image formation surface" as the adjustment conditions.

In the image forming apparatus 10 according to the present embodiment, the printer unit 141 that forms a special image is provided upstream of the printer unit 140 that forms a color image in the conveying direction (the arrow X direction in FIG. 1) of the intermediate transfer belt 125. Thus, the image transferred onto the intermediate transfer belt 125 and then onto the recording medium P is formed on the recording medium P with the color image and the special image formed in this order.

Figure 6:
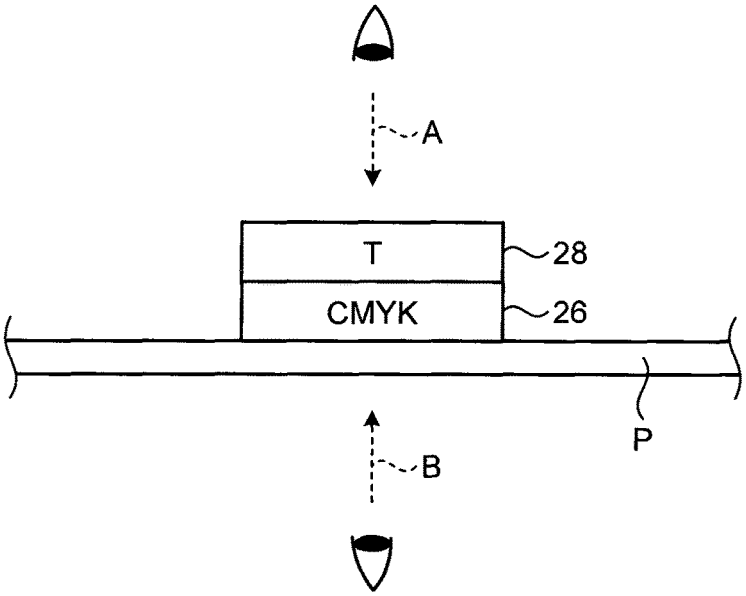
FIG. 6 is a schematic illustrating a state where an image is formed on a recording medium.

FIG. 6 is a schematic illustrating a state where an image is formed on the recording medium P. In a case where the image forming unit 1 in the image forming apparatus 10 according to the present embodiment has the configuration illustrated in FIG. 1, a color image 26 and a special image 28 are formed on the recording medium P in this order as illustrated in FIG. 6. In this case, observation from the image formation surface means observation of the image (the color image 26 and the special image 28) in the arrow A direction in FIG. 6. By contrast, observation from the surface opposite to the image formation surface means observation of the image (the color image 26 and the special image 28) in the arrow B direction in FIG. 6 through the recording medium P.

Therefore, the storage unit 2C stores therein the adjustment conditions in advance.

In a case where the image forming unit 1 forms the special image and the color image on the recording medium P in this order, the storage unit 2C stores therein in advance adjustment conditions different from those illustrated in FIG. 5.

Figure 7:
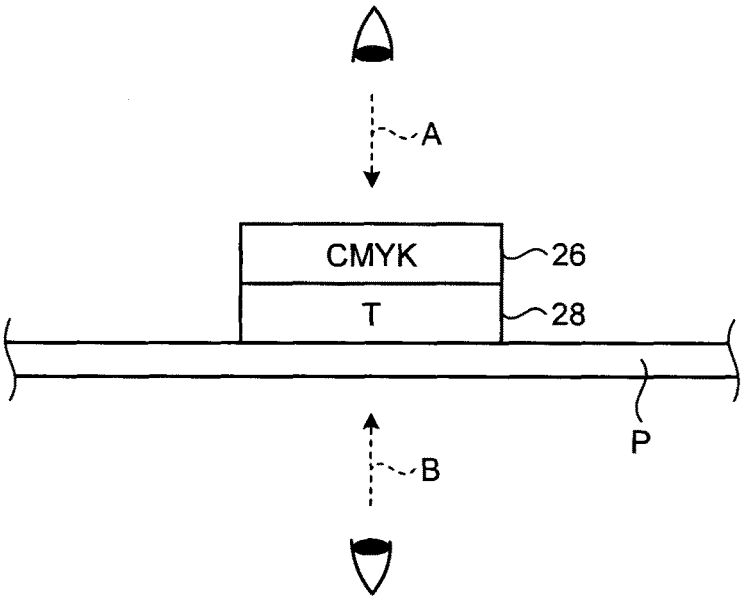
FIG. 7 is a schematic for explaining an image formed on the recording medium.

FIG. 7 is a schematic for explaining an image formed on the recording medium P with the special image 28 and the color image 26 formed in this order. In this case, observation from the image formation surface means observation of the image (the special image 28 and the color image 26) in the arrow A direction in FIG. 7. By contrast, observation from the surface opposite to the image formation surface means observation of the image (the special image 28 and the color image 26) in the arrow B direction in FIG. 7 through the recording medium P.

In a case where the image forming unit 1 forms the special image 28 and the color image 26 on the recording medium P in the order illustrated in FIG. 7, the adjustment conditions simply need to be information opposite to the adjustment conditions illustrated in FIG. 5.

Specifically, in a case where the image forming unit 1 forms the images in the order illustrated in FIG. 7, the storage unit 2C registers in advance the adjustment content "no adjustment in density" corresponding to the type of the special toner "transparent toner" and the observation surface "surface opposite to the image formation surface" as the adjustment conditions. The storage unit 2C also registers in advance the adjustment content "reduction in density" corresponding to the type of the special toner "transparent toner" and the observation surface "image formation surface" as the adjustment conditions. The storage unit 2C also registers in advance the adjustment content "reduction in density" corresponding to the type of the special toner "white toner" and the observation surface "surface opposite to the image formation surface" as the adjustment conditions. The storage unit 2C also registers in advance the adjustment content "no adjustment in density" corresponding to the type of the special toner "white toner" and the observation surface "image formation surface" as the adjustment conditions. The storage unit 2C may also register in advance the adjustment content "reduction in density" corresponding to the type of the special toner "non-transparent toner" and the observation surface "surface opposite to the image formation surface" as the adjustment conditions. The storage unit 2C may also register in advance the adjustment content "no adjustment in density" corresponding to the type of the special toner "non-transparent toner" and the observation surface "image formation surface" as the adjustment conditions.

Referring back to FIG. 3, the determining unit 2F determines whether the image formed on the recording medium P is to be observed from the image formation surface or observed from the surface opposite to the image formation surface through the recording medium P. The determining unit 2F makes the determination based, on the front and back determination conditions stored in the storage unit 2C.

Let us assume that the storage unit 2C stores therein in advance the front and back determination conditions illustrated in FIG. 4A. In this case, the determining unit 2F reads, from the front and back determination conditions, the observation surface corresponding to the specification information (the front side or the back side) accepted by the accepting unit 2B from the operating unit 3. Thereby, the determining unit 2F determines whether the observation surface is the image formation surface or the surface opposite to the image formation surface.

Specifically, let us assume that the observation surface specified by the specification information accepted by the accepting unit 2B from the operating unit 3 is information indicating the "front side". In this case, the determining unit 2F reads the observation surface "image formation surface" corresponding to the specification information "front side" from the front and back determination conditions, thereby determining the "image formation surface" as the observation surface. By contrast, let us assume that the observation surface specified by the specification information accepted by the accepting unit 2B from the operating unit 3 is information indicating the "back side". In this case, the determining unit 2F reads the observation surface corresponding to the specification information "back side" from the front and back determination conditions, thereby determining the "surface opposite to the image formation surface" as the observation surface.

Furthermore, let us assume that the storage unit 2C stores therein the front and back determination conditions illustrated in FIG. 4B. In this case, the determining unit 2F reads the observation surface corresponding to the specification content accepted by the accepting unit 2B from the operating unit 3 and to the detection result (transparent or non-transparent) obtained by the detecting unit 150 from the front and back determination conditions. Thereby, the determining unit 2F determines whether the observation surface is the image formation surface or the surface opposite to the image formation surface.

Specifically, let us assume that the instruction content accepted by the accepting unit 2B from the operating unit 3 is "presence of mirror-image printing specification" and that the type of the recording medium P detected by the detecting unit 150 is "transparent". In this case, the determining unit 2F determines the "surface opposite to the image formation surface" as the observation surface corresponding to "presence of mirror-image printing specification" and "transparent" in the front and back determination conditions. By contrast, let us assume that the instruction content is "presence of mirror-image printing specification" and that the type of the recording medium P is "non-transparent". In this case, the determining unit 2F determines the "image formation surface" as the observation surface corresponding to "presence of mirror-image printing specification" and "non-transparent" in the front and back determination conditions.

Let us assume that the instruction content accepted by the accepting unit 2B from the operating unit 3 is "absence of mirror-image printing specification" and that the type of the recording medium P detected by the detecting unit 150 is "transparent". In this case, the determining unit 2F determines the "image formation surface" as the observation surface corresponding to "absence of mirror-image printing specification" and "transparent" in the front and back determination conditions. By contrast, let us assume that the instruction content is "absence of mirror-image printing specification" and that the type of the recording medium P is "non-transparent". In this case, the determining unit 2F determines the "image formation surface" as the observation surface corresponding to "absence of mirror-image printing specification" and "non-transparent" in the front and back determination conditions.

Furthermore, let us assume that the storage unit 2C stores therein in advance the front and back determination conditions illustrated in FIG. 4C. In this case, the determining unit 2F reads the observation surface corresponding to the detection result (transparent or non-transparent) obtained by the detecting unit 150 from the front and back determination conditions, thereby determining whether the observation surface is the image formation surface or the surface opposite to the image formation surface.

Specifically, let us assume that the type of the recording medium P detected by the detecting unit 150 is "transparent". In this case, the determining unit 2F reads the observation surface "surface opposite to the image formation surface" corresponding to the type of the recording medium "transparent" from the front and back determination conditions, thereby determining the "surface opposite to the image formation surface" as the observation surface. By contrast, let us assume that the type of the recording medium P detected by the detecting unit 150 is "non-transparent". In this case, the determining unit 2F reads the observation surface "image formation surface" corresponding to the type of the recording medium "non-transparent" from the front and back determination conditions, thereby determining the "image formation surface" as the observation surface.

Referring back to FIG. 3, the adjusting unit 2G performs adjustment to reduce the density value of the special image data based on the result of determination made by the determining unit 2F and the adjustment conditions stored in the storage unit 2C.

Specifically, the adjusting unit 2G reads the adjustment content corresponding to the type of the special toner provided to the image forming apparatus 10 and to the result of determination (the image formation surface or the surface opposite to the image formation surface) made by the determining unit 2F from the adjustment conditions stored in the storage unit 2C. If the corresponding adjustment content is "reduction in density", the adjusting unit 2G performs adjustment to reduce the density value of the special image data.

If the corresponding adjustment content is "reduction in density", the adjusting unit 2G according to the present embodiment performs adjustment to reduce the density value of the special image data by a first rate.

The first rate is a rate by which the amount of the special toner specified by the density value of the special image data is reduced to the minimum amount required to provide a desired special effect. The first rate is calculated in advance based on the type of the special toner and the type of the color toner used by the image forming apparatus 10 and on the order of formation of the special image 28 and the color image 26 on the recording medium P so as to satisfy the conditions described above. The calculated first rate is then stored in the storage unit 2C. The first rate stored in the storage unit 2C may be changed by an operating instruction issued by the user through the operating unit 3.

The storage unit 2C, for example, stores therein in advance the first rate corresponding to the type of the special toner, the type of the color toner, and the order of formation of the special image 28 and the color image 26 on the recording medium P. The adjusting unit 2G simply needs to read the first rate corresponding to the type of the special toner to be used for image formation, the type of the color toner to be used for image formation, and the order of formation from the storage unit 2C. The adjusting unit 2G then uses the read first rate, thereby performing adjustment to reduce the density value of the special image data by the first rate. The print data received from the external device includes the type of the color toner and the type of the special toner to be used for image formation and the order of formation. The adjusting unit 2G simply needs to read the type of the color toner and the type of the special toner to be used for image formation and the order of formation included in the print data.

Figure 8:
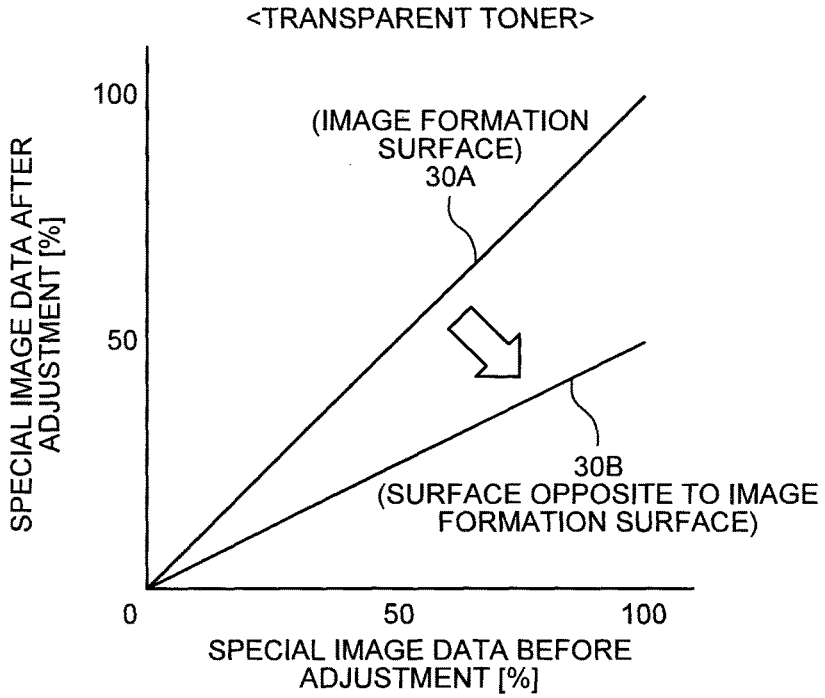
FIG. 8 is a graph of a relation between the density value of special image data before adjustment and the density value of the special image data after adjustment.

FIG. 8 is a graph of a relation between the density value of the special image data before adjustment and the density value of the special image data after adjustment in a case where the transparent toner is used as the special toner.

In a case where the adjusting unit 2G performs no density adjustment, the density value of the special image data is not changed before and after adjustment. In this case, the relation of the values before and after density adjustment is indicated by the line 30A. By contrast, in a case where the adjusting unit 2G performs adjustment to reduce the density value of the special image data by the first rate, the relation of the values before and after density adjustment is indicated by the line 30B.

As described above, the adjusting unit 2G performs adjustment to reduce the density value of each pixel in the special image data by the first rate, based on the result of determination made by the determining unit 2F and the adjustment conditions (refer to FIG. 5) stored in the storage unit 2C.

In the image forming apparatus 10 that forms the color image 26 and the special image 28 on the recording medium P in this order (refer to FIG. 6), if the transparent toner is used as the special toner, and the observation surface is the surface opposite to the image formation surface, the adjusting unit 2G performs adjustment to reduce the density value of the special image data used to form the transparent toner image by the first rate. By contrast, in the image forming apparatus 10 that forms the color image 26 and the special image 28 on the recording medium P in this order (refer to FIG. 6), if the transparent toner is used as the special toner, and the observation surface is the image formation surface, the adjusting unit 2G does not adjust the density value of the special image data used to form the transparent toner image and retains the density value without any change.

Figure 9:
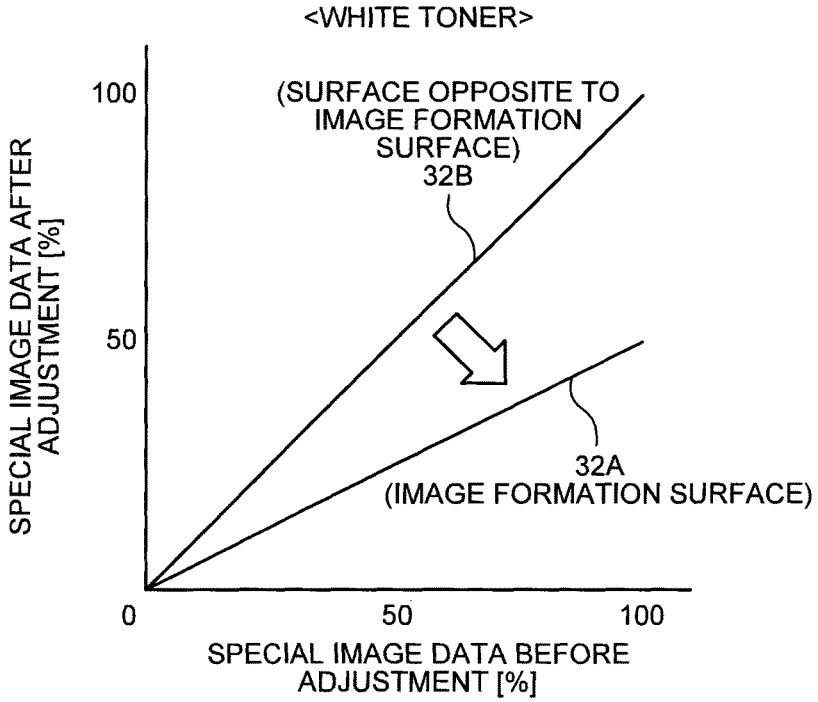
FIG. 9 is a graph of a relation between the density value of the special image data before the adjustment and the density value of the special image data after adjustment.

FIG. 9 is a graph of a relation between the density value of the special image data before adjustment and the density value of the special image data after adjustment in a case where the white toner is used as the special toner.

Also in the case where the white toner is used as the special toner, if the adjusting unit 2G performs no density adjustment, the density value of the special image data is not changed before and after adjustment. In this case, the relation of the values before and after density adjustment is indicated by the line 32B. By contrast, if the adjusting unit 2G performs adjustment to reduce the density value of the special image data by the first rate, the relation of the values before and after density adjustment is indicated by the line 32A.

As described above, the adjusting unit 2G performs adjustment to reduce the density value of each pixel in the special image data by the first rate, based on the result of determination made by the determining unit 2F and the adjustment conditions (refer to FIG. 5) stored in the storage unit 2C.

As described above, the storage unit 2C stores therein in advance the adjustment conditions specifying opposite adjustment contents in the case of using the white toner as the special toner and the case of using the transparent toner as the special toner. In the image forming apparatus 10 that forms the color image 26 and the special image 28 on the recording medium P in this order (refer to FIG. 6), if the white toner is used as the special toner, and the observation surface is the image formation surface, the adjusting unit 2G performs adjustment to reduce the density value of the special image data used to form the white toner image by the first rate (refer to the line 32A in FIG. 9). By contrast, in the image forming apparatus 10 that forms the color image 26 and the special image 28 on the recording medium P in this order (refer to FIG. 6), if the white toner is used as the special toner, and the observation surface is the surface opposite to the image formation surface, the adjusting unit 2G does not adjust the density value of the special image data used to form the white toner image and retains the density value without any change.

Figure 10:
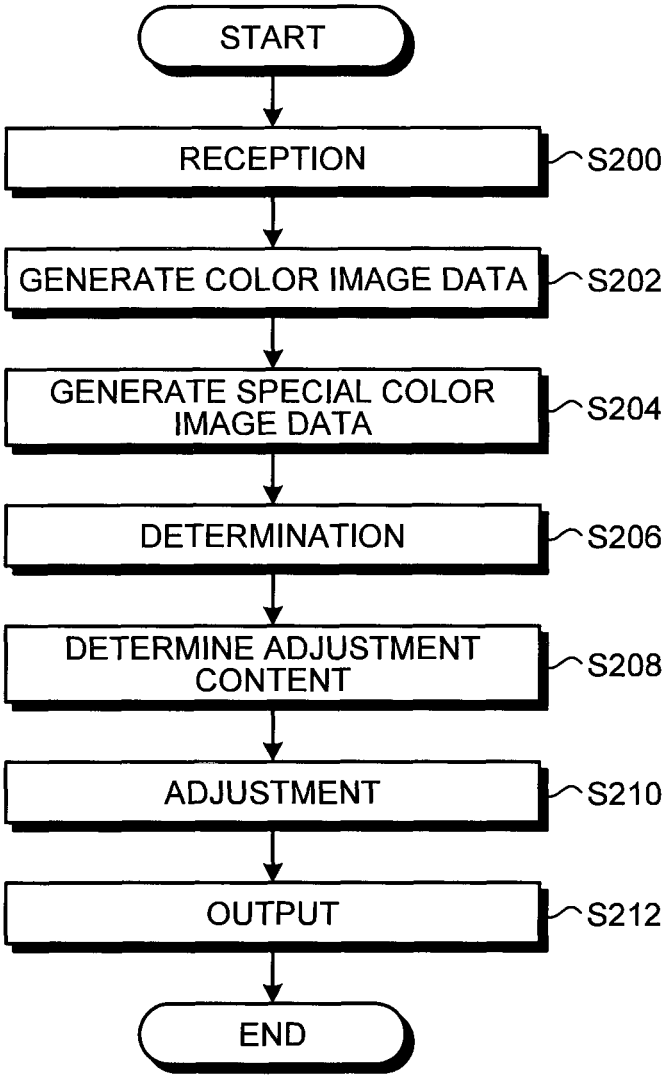
FIG. 10 is a flowchart of a process of image formation.

The following describes a process of image formation performed by the control unit 2 of the image forming apparatus 10 according to the present embodiment. FIG. 10 is a flowchart of the process of image formation.

If a power switch, which is not illustrated, of the image forming apparatus 10 is turned on to supply power to each unit in the image forming apparatus 10, the control unit 2 starts the image formation illustrated in FIG. 10.

The receiving unit 2D receives print data from the external device via the communication unit 4 (Step S200). The generating unit 2E generates color image data from color print data included in the print data received at Step S200 (Step S202).

The generating unit 2E generates special image data from special print data included in the print data received at Step S200 (Step S204).

The determining unit 2F determines whether the image formed on the recording medium P is to be observed from the image formation surface or observed from the surface opposite to the image formation surface through the recording medium P (Step S206). The determining unit 2F makes the determination at Step S206 based on the front and back determination conditions stored in the storage unit 2C.

Let us assume that the storage unit 2C stores therein in advance the front and back determination conditions illustrated in FIG. 4A. In this case, the determining unit 2F reads, from the front and back determination conditions, the observation surface corresponding to the observation surface specified by the specification information accepted by the accepting unit 2B from the operating unit 3. Thereby, the determining unit 2F determines whether the observation surface is the image formation surface or the surface opposite to the image formation surface. Let us assume that the storage unit 2C stores therein the front and back determination conditions illustrated in FIG. 4B. In this case, the determining unit 2F reads the observation surface corresponding to the specification content accepted by the accepting unit 2B from the operating unit 3 and to the detection result (transparent or non-transparent) obtained by the detecting unit 150 from the front and back determination conditions. Thereby, the determining unit 2F determines whether the observation surface is the image formation surface or the surface opposite to the image formation surface. Let us assume that the storage unit 2C stores therein in advance the front and back determination conditions illustrated in FIG. 4C. In this case, the determining unit 2F reads the observation surface corresponding to the detection result (transparent or non-transparent) obtained by the detecting unit 150 from the front and back determination conditions. Thereby, the determining unit 2F determines whether the observation surface is the image formation surface or the surface opposite to the image formation surface.

The adjusting unit 2G determines the adjustment content for the special image data (Step S208). The adjusting unit 2G reads the adjustment content corresponding to the type of the special toner provided to the image forming apparatus 10 and to the result of determination (the image formation surface or the surface opposite to the image formation surface) made by the determining unit 2F at Step S206 from the adjustment conditions stored in the storage unit 2C. Thus, the adjusting unit 2G determines the adjustment content for the special image data.

The type of the special toner provided to the image forming apparatus 10 is acquired as follows. The image forming apparatus 10 is provided with a sensor (not illustrated) that reads a product number written on the container of the cartridge 121T holding the special toner, for example. The control unit 2 stores the product number and the type of the special toner (the transparent toner or the white toner) in a manner associated with each other. The control unit 2 then reads the type of the special toner corresponding to the product number read by the sensor, thereby acquiring the type of the special toner. Alternatively, the type of the special toner provided to the image forming apparatus 10 may be fixed, and the control unit 2 may store in advance the type of the special toner provided to the image forming apparatus 10. The adjusting unit 2G may read and acquire the type of the special toner stored in advance at Step S208.

The adjusting unit 2G adjusts the density value of each pixel in the special image data based on the adjustment content determined at Step S208 (Step S210). In other words, if the adjustment content determined at Step S208 is "reduction in density", the adjusting unit 2G performs adjustment to reduce the density value of each pixel in the special image data by the first rate. By contrast, if the adjustment content determined at Step S208 is "no adjustment in density", the adjusting unit 2G does not adjust the density value of each pixel in the special image data and retains the density value without any change.

The control unit 2 outputs image data including the color image data generated by the generating unit 2E and the special image data adjusted by the adjusting unit 2G to the image forming unit 1 (Step S212). The present routine is then terminated.

If the image forming unit 1 receives the image data from the control unit 2, the image forming unit 1 forms an image corresponding to the received image data on the recording medium P.

As described above, in the image forming apparatus 10 according to the present embodiment, the determining unit 2F determines whether the image is to be observed from the image formation surface of the recording medium P or observed from the surface opposite to the image formation surface of the recording medium P through the recording medium P. The adjusting unit 2G performs adjustment to reduce the density value of the special image data by the first rate, based on the result of determination made by the determining unit 2F.

Thus, it is possible to suppress unnecessary consumption of the special toner.

Specifically, in the image forming apparatus 10 that forms the color image 26 and the special image 28 on the recording medium P in this order (refer to FIG. 6), if the transparent toner is used as the special toner, and the observation surface is the surface opposite to the image formation surface, the adjusting unit 2G performs adjustment to reduce the density value of the special image data used to form the transparent toner image by the first rate. By contrast, in the image forming apparatus 10 that forms the color image 26 and the special image 28 on the recording medium P in this order (refer to FIG. 6), if the transparent toner is used as the special toner, and the observation surface is the image formation surface, the adjusting unit 2G does not adjust the density value of the special image data used to form the transparent toner image and retains the density value without any change.

Thus, the present embodiment can suppress an unnecessary increase in consumption of the special toner and fluctuations in glossiness of the recording medium P.

Figure 11:
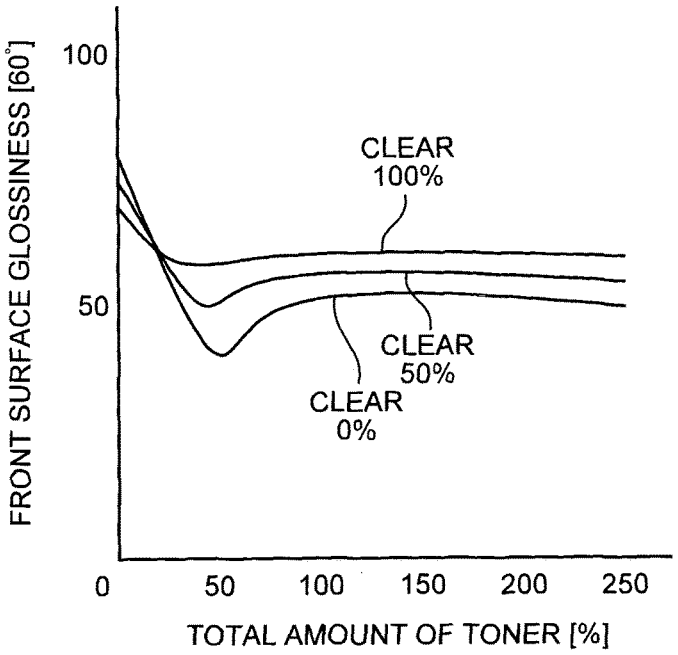
FIG. 11 is a graph of an example of a relation between the total amount of toners and front surface glossiness.
Figure 12:
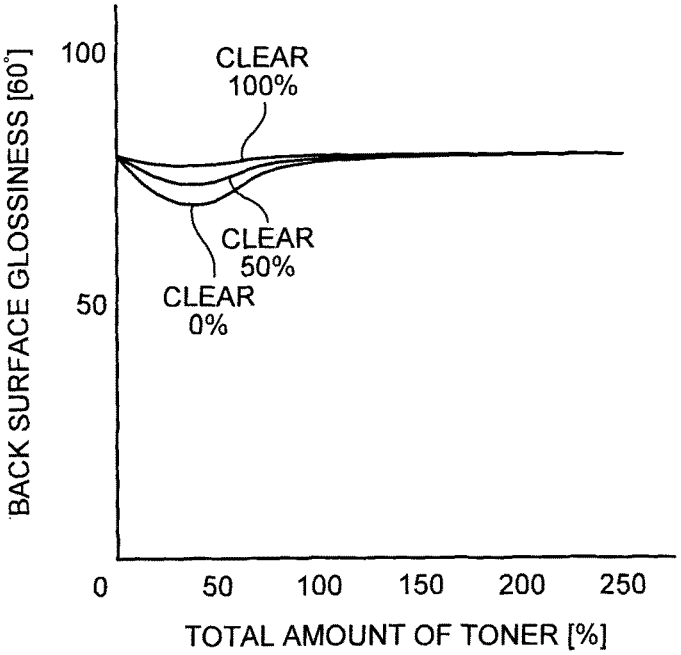
FIG. 12 is a graph of an example of a relation between the total amount of toners and back surface glossiness.

FIG. 11 is a graph of an example of a relation between the total amount of color toners (total amount of toners) and front surface glossiness in a case where the color toners of CMYK are applied to the transparent recording medium P. FIG. 12 is a graph of an example of a relation between the total amount of color toners (total amount of toners) and back surface glossiness in a case where the color toners of CMYK are applied to the transparent recording medium P.

The front surface glossiness is the glossiness of the image formation surface of the recording medium P. The back surface glossiness is the glossiness of the surface (back surface) opposite to the image formation surface of the recording medium P.

Figure 13A:
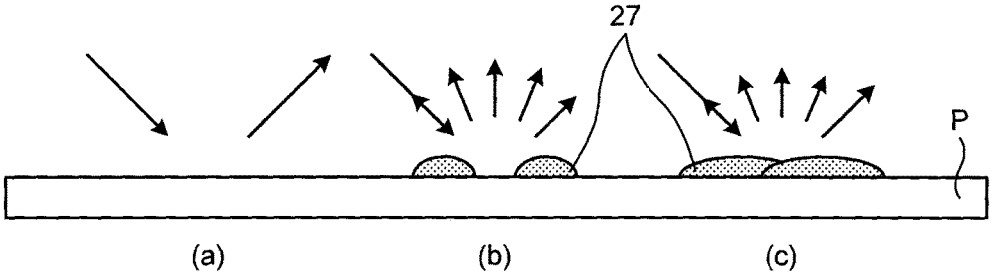
FIGS. 13A and 13B are schematics for explaining reflecting and scattering states of light.
Figure 13B:
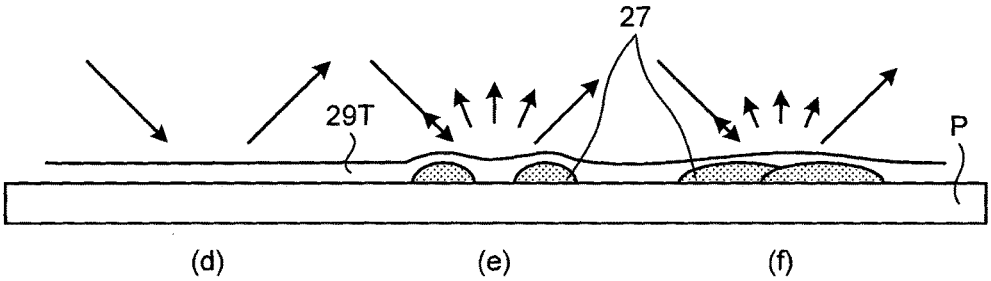

In FIGS. 11 and 12, clear 100% indicates a state where a transparent toner 29T (refer to FIGS. 13A and 13B) having a density value (total amount of the toner) of 100% is superimposed on a color toner 27 (refer to FIGS. 13A and 13B). Clear 50% indicates a state where the transparent toner 29T having a density value (total amount of the toner) of 50% is superimposed on the color toner 27. Clear 0% indicates a state where the transparent toner 29T having a density value (total amount of the toner) of 0% is superimposed on the color toner 27, that is, a state where no transparent toner 29T is applied.

Figure 14A:
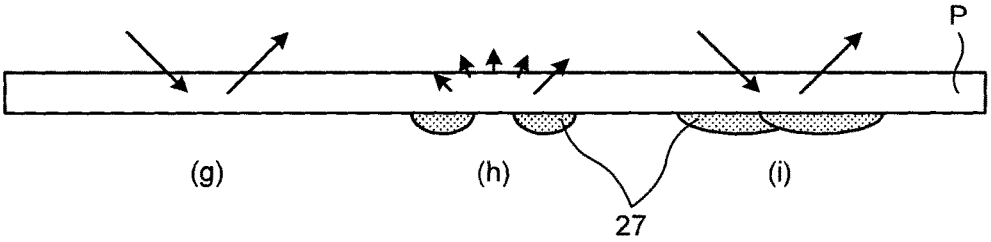
FIGS. 14A and 14B are schematics for explaining reflecting and scattering states of light.
Figure 14B:
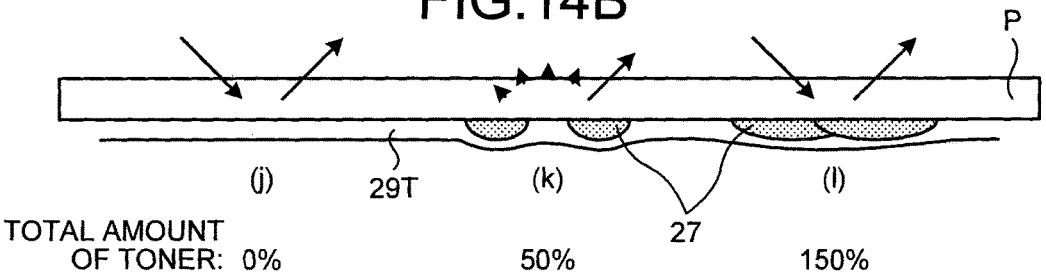

FIGS. 13A and 13B are schematics for explaining reflecting and scattering states of light on the front surface (image formation surface) of the recording medium P on which the image is formed with the color toner 27 and the transparent toner 29T. FIGS. 14A and 14B are schematics for explaining reflecting and scattering states of light on the back surface (surface opposite to the image formation surface) of the recording medium P on which the image is formed with the color toner 27 and the transparent toner 29T.

In FIGS. 13A to 14B, light is incident on the recording medium P from the upper left in FIGS. 13 and 14, and regularly reflected light travels toward the upper right in FIGS. 13 and 14. The intensity of the regularly reflected light strongly correlates with the intensity of glossiness.

As illustrated in FIGS. 11 and 12, the glossiness in a case where the total amount of the color toner 27 is 0% is equal to the glossiness of the recording medium P itself (refer to clear 0% in FIGS. 11 and 12). In the example illustrated in FIGS. 11 and 12, the recording medium P having high glossiness is used. As the total amount of the color toner applied to the recording medium P is increased, the glossiness (the front surface glossiness and the back surface glossiness) is temporarily decreased and then increased and is saturated at certain glossiness (the front surface glossiness and the back surface glossiness) (refer to clear 0% in FIGS. 11 and 12).

A state where the total amount of the color toner 27 is increased is illustrated at (a) to (c) in FIGS. 13A and 13B and (g) to (i) in FIGS. 14A and 14B.

The glossiness (the front surface glossiness and the back surface glossiness) is temporarily decreased in the process of increasing the total amount of the color toner 27 as indicated by the line of clear 0% in FIGS. 11 and 12 for the following reason. That is, this is because the color toner 27 recorded on the recording medium P by halftone processing scatters light and thus reduces regularly reflected light (refer to (b) in FIG. 13A and (h) in FIG. 14A). If the total amount of the color toner 27 is further increased, the entire surface of the recording medium P is covered with the color toner 27 (refer to (c) in FIG. 13A and (i) in FIG. 14A). Thus, scattering of light is reduced, and the glossiness of the color toner 27 itself has a dominant influence, resulting in the saturated glossiness (refer to clear 0% in FIGS. 11 and 12).

In comparison of the front surface glossiness (refer to FIG. 11) with the back surface glossiness (refer to FIG. 12), the fluctuation range of the back surface glossiness is smaller than that of the front surface glossiness. This is because the back surface glossiness is significantly affected by the glossiness of the recording medium P itself (refer to (g) in FIG. 14A), and the color toner 27 applied to the opposite surface is less likely to affect the glossiness.

In FIG. 11, the front surface glossiness is gradually increased when the glossiness is saturated because of the increase in the total amount of the color toner for the following reason. That is, this is because the transparent toner 29T is made of a material capable of providing higher glossiness than that of the color toner 27. In a case where the transparent toner 29T is made of a material having glossiness equivalent to that of the color toner, the change in the front surface glossiness is substantially constant when the glossiness is saturated because of the increase in the total amount of the color toner in FIG. 11.

In a case where the transparent toner 29T is superimposed on the color toner 27 as illustrated in FIGS. 11 to 14B (refer to clear 50% and clear 100% in FIGS. 11 and 12), the transparent toner 29T scatters light. Compared with the case where no transparent toner 29T is superimposed, reduction in the front surface glossiness is small (refer to (e) and (f) in FIG. 13B). By superimposing the transparent toner 29T on the color toner 27, it is possible to suppress fluctuations in the front surface glossiness due to the total amount of the color toner 27.

The back surface glossiness has a smaller range of reduction than that of the front surface glossiness in the process of increasing the total amount of the color toner (refer to FIGS. 11 and 12). In a case where the transparent toner 29T is used as the special toner, the color image 26 and the special image 28 are formed with the color toner 27 and the transparent toner 29T, respectively, on the recording medium P in this order, and the image is observed from the surface opposite to the image formation surface through the recording medium P, a smaller amount of the transparent toner 29T is required to reduce fluctuations in the glossiness.

In the image forming apparatus 10 according to the present embodiment that forms the color image 26 and the special image 28 on the recording medium P in this order (refer to FIG. 6), if the transparent toner is used as the special toner, and the observation surface is the surface opposite to the image formation surface, the adjusting unit 2G performs adjustment to reduce the density value of the special image data used to form the transparent toner image by the first rate. With this adjustment, the image forming apparatus 10 according to the present embodiment can suppress an unnecessary increase in consumption of the special toner and fluctuations in glossiness of the recording medium P.

In the image forming apparatus 10 that forms the color image 26 and the special image 28 on the recording medium P in this order (refer to FIG. 6), if the white toner is used as the special toner, and the observation surface is the image formation surface, the adjusting unit 2G performs adjustment to reduce the density value of the special image data used to form the white toner image by the first rate as described above. In the image forming apparatus 10 that forms the color image 26 and the special image 28 on the recording medium P in this order (refer to FIG. 6), if the white toner is used as the special toner, and the observation surface is the surface opposite to the image formation surface, the adjusting unit 2G does not adjust the density value of the special image data used to form the white toner image and retains the density value without any change.

Figure 15:
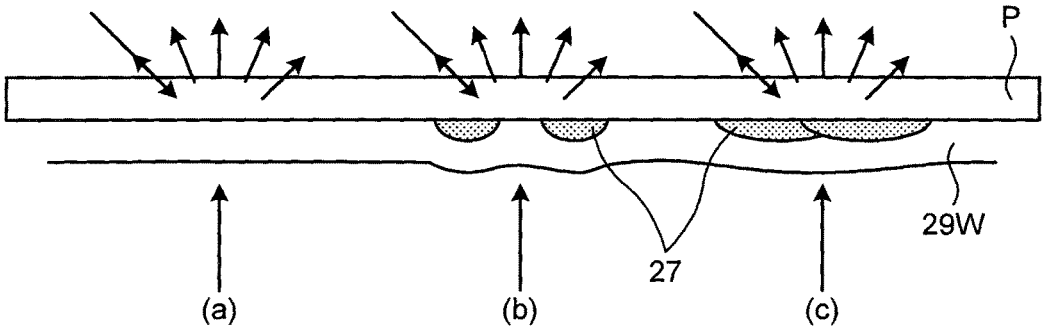
FIG. 15 is a schematic for explaining reflecting and scattering states of light.
Figure 16:
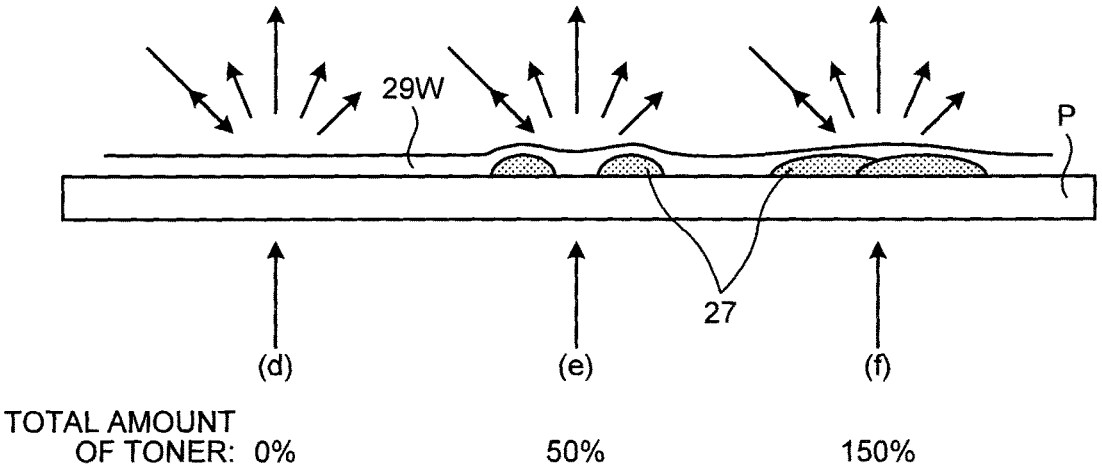
FIG. 16 is a schematic for explaining reflecting and scattering states of light.

FIG. 15 is a schematic for explaining reflecting and scattering states of light on the back surface (surface opposite to the image formation surface) of the recording medium P on which the image is formed with the color toner 27 and a white toner 29W. FIG. 16 is a schematic for explaining reflecting and scattering states of light on the front surface (image formation surface) of the recording medium P on which the image is formed with the color toner 27 and the white toner 29W.

As illustrated in FIG. 15, if the recording medium P is observed from the surface opposite to the image formation surface, the color toner 27 is observed through the recording medium P. In this case, the white toner 29W has a function to block light from the back side of the color toner 27 (lower side in FIG. 15). To effectively exert the function to block light from the back side, a larger amount of the white toner 29W is preferably used.

In the image forming apparatus 10 according to the present embodiment that forms the color image 26 and the special image 28 on the recording medium P in this order (refer to FIG. 6), if the white toner is used as the special toner, and the observation surface is the surface opposite to the image formation surface, the adjusting unit 2G does not adjust the density value of the special image data used to form the white toner image and retains the density value without any change.

By contrast, if the recording medium P is observed from the image formation surface as illustrated in FIG. 16, the color toner 27 is directly observed not through the recording medium P. In this case, if a large amount of the white toner 29W is used, the color of the color toner 27 is shielded and hard to view. To address this, in the image forming apparatus 10 that forms the color image 26 and the special image 28 on the recording medium P in this order (refer to FIG. 6), if the white toner 29W is used as the special toner, and the observation surface is the image formation surface, the adjusting unit 2G performs adjustment to reduce the density value of the special image data used to form the image of the white toner 29W by the first rate.

Because the white toner 29W can be translucent as described above, the color image 26 formed with the color toner 27 can be observed.

Thus, the present embodiment can suppress an unnecessary increase in consumption of the special toner.

In a case where the image forming unit 1 of the image forming apparatus 10 forms the special image 28 and the color image 26 on the recording medium P in this order (refer to FIG. 7), the storage unit 2C registers information opposite to the adjustment content illustrated in FIG. 5 as the adjustment conditions as described above.

Thus, also in the case where the image forming unit 1 forms the special image 28 and the color image 26 on the recording medium P in this order, it is possible to suppress an unnecessary increase in consumption of the special toner in the same manner as described above.

As described above, the present embodiment adjusts the density value of the special image data specifying the density value for each pixel. The special image data the density value of which is to be adjusted simply needs to be image data used to form the special toner image and is not limited to the data in the embodiment above. In other words, a known system and an image forming apparatus having a function to form an image with a special toner may use image data used to form the special toner image as the special image data according to the present embodiment. Thus, the system and the apparatus may adjust the density value based on a determination result of the image formation surface or the surface opposite to the image formation surface in the same manner as described above.

More specifically, the image data the density value of which is to be adjusted may be clear version data described in Japanese Patent Application Laid-open No. 2012-83736. Also in this case, the same effects as those of the present embodiment can be achieved.

Figure 17:
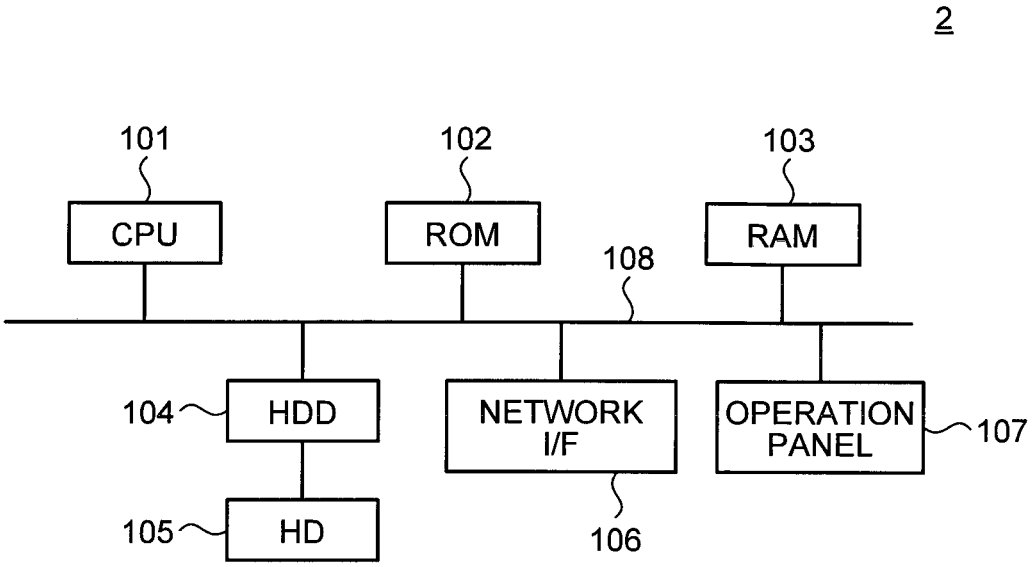
FIG. 17 is a block diagram of a hardware configuration of a control unit.

The following describes a hardware configuration of the control unit 2 according to the present embodiment. FIG. 17 is a block diagram of a hardware configuration of the control unit 2.

The control unit 2 includes a CPU 101, a ROM 102, RAM 103, an HDD 104, a hard disk (HD) 105, a network interface (I/F) 106, and an operation panel 107. The CPU 101, the ROM 102, the RAM 103, the HDD 104, the HD 105, the network I/F 106, and the operation panel 107 are connected to one another via a bus 108 and have a hardware configuration using a typical computer.

The computer program for executing the various types of processing performed by the image forming apparatus 10 according to the present embodiment is embedded in advance and provided in the ROM 102, for example.

The computer program for executing the various types of processing performed by the image forming apparatus 10 according to the present embodiment may be recorded and provided in a computer-readable recording medium, such as a compact disc read only memory (CD-ROM), a flexible disk (FD), a compact disc recordable (CD-R), and a digital versatile disc (DVD), as an file installable or executable by the apparatus.

The computer program for executing the various types of processing performed by the image forming apparatus 10 according to the present embodiment may be stored in a computer connected to a network, such as the Internet, and provided by being downloaded via the network. Furthermore, the computer program for executing the various types of processing performed by the image forming apparatus 10 according to the present embodiment may be provided or distributed via a network, such as the Internet.

The computer program for executing the various types of processing performed by the image forming apparatus 10 according to the present embodiment has a module configuration including the units described above (the acquiring unit 2A, the accepting unit 2B, the storage unit 2C, the receiving unit 2D, the generating unit 2E, the determining unit 2F, and the adjusting unit 2G). In actual hardware, the CPU 101 reads and executes the computer program from a memory, such as the ROM 102, to load each unit on the main memory. Thus, these units are generated on the main memory.

An embodiment can reduce the amount of consumption of a special toner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

1 image forming unit
2 control unit
2A acquiring unit
2B accepting unit
2F determining unit
2G adjusting unit
10 image forming apparatus

CITATION LIST

Patent Literature 1: Japanese Laid-open Patent Publication No. 2009-058941

The invention claimed is:

1. An image forming apparatus comprising:

an image forming unit, including a plurality of photoconductive surfaces and different types of toner, that forms, on a recording medium, an image including a special image based on special image data specifying a density value of a special toner which is a clear toner that gives a special effect and a color image based on color image data specifying a density value of a color toner;

a determining unit, including circuitry, that determines whether the image is to be observed from an image formation surface or the image is to be observed from a surface opposite to the image formation surface through the recording medium; and an adjusting unit, including circuitry, that performs adjustment to reduce the density value of the special image data based on a result of determination made by the determining unit.

2. The image forming apparatus according to claim 1, wherein the adjusting unit performs the adjustment to reduce the density value of the special image data by a first rate, based on the result of determination made by the determining unit.

3. The image forming apparatus according to claim 1, further comprising:

an accepting unit, implemented using circuitry, that accepts input of specification information specifying an observation surface of the image on the recording medium, wherein the determining unit determines that the image is to be observed from the image formation surface when the observation surface specified by the specification information is a front side and that the image is to be observed from the surface opposite to the image formation surface when the observation surface specified by the specification information is a back side.

4. The image forming apparatus according to claim 1, further comprising:

a detecting unit, implemented using a sensor, that detects whether the recording medium is transparent or non-transparent, wherein the determining unit determines that the image is to be observed from the surface opposite to the image formation surface when a detection result obtained by the detecting unit indicates the recording medium is transparent and that the image is to be observed from the image formation surface when the detection result indicates the recording medium is non-transparent.

5. The image forming apparatus according to claim 4, further comprising:

an accepting unit, implemented using circuitry, that accepts specification of mirror-image printing for performing mirror-image conversion on the image and printing the image, wherein the determining unit determines that the image is to be observed from the surface opposite to the image formation surface when the detection result indicates the recording medium is transparent and when the specification of mirror-image printing is accepted and that the image is to be observed from the image formation surface when the detection result indicates the recording medium is non-transparent or when no specification of mirror-image printing is accepted.

6. The image forming apparatus according to claim 1, wherein the image forming unit forms the color image and the special image on the recording medium in a superimposed manner in this order, and the adjusting unit performs adjustment to reduce the density value of the special image data when the image is determined to be observed from the surface opposite to the image formation surface through the recording medium.

7. The image forming apparatus according to claim 1, wherein the image forming unit forms the special image and the color image on the recording medium in a superimposed manner in this order, and the adjusting unit performs adjustment to reduce the density value of the special image data when the image is determined to be observed from the image formation surface.

8. An image forming method performed by an image forming apparatus including an image forming unit, including a plurality of photoconductive surfaces and different types of toner, that forms, on a recording medium, an image including a special image based on special image data specifying a density value of a special toner that includes clear toner that gives a special effect and a color image based on color image data specifying a density value of a color toner, the image forming method comprising:

determining whether the image is to be observed from an image formation surface or the image is to be observed from a surface opposite to the image formation surface through the recording medium; and performing adjustment to reduce the density value of the special image data corresponding to the clear toner based on a result of determination made at the determining.

9. A computer program product comprising a non-transitory computer-readable medium containing an information processing program, the program causing a computer connected to an image forming unit, including a plurality of photoconductive surfaces and different types of toner, that forms, on a recording medium, an image including a special image based on special image data specifying a density value of a special toner that includes clear toner that gives a special effect and a color image based on color image data specifying a density value of a color toner to perform:

determining whether the image is to be observed from an image formation surface or the image is to be observed from a surface opposite to the image formation surface through the recording medium; and performing adjustment to reduce the density value of the special image data corresponding to the clear toner based on a result of determination made at the determining.

* * * * *